US011739658B2

(12) United States Patent
Flitan et al.

(10) Patent No.: US 11,739,658 B2
(45) Date of Patent: Aug. 29, 2023

(54) STRUT COVER FOR A TURBINE

(71) Applicant: Siemens Energy Global GmbH & Co. KG, Munich (DE)

(72) Inventors: Horia Flitan, Jupiter, FL (US); Farzad Taremi, Palm Beach Gardens, FL (US); Li Shing Wong, Oviedo, FL (US); Ross Gustafson, Charlotte, NC (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 17/906,357

(22) PCT Filed: Mar. 20, 2020

(86) PCT No.: PCT/US2020/023838
§ 371 (c)(1),
(2) Date: Sep. 15, 2022

(87) PCT Pub. No.: WO2021/188114
PCT Pub. Date: Sep. 23, 2021

(65) Prior Publication Data

US 2023/0036034 A1 Feb. 2, 2023

(51) Int. Cl.
*F01D 25/16* (2006.01)
*F01D 9/04* (2006.01)

(52) U.S. Cl.
CPC ..... *F01D 25/162* (2013.01); *F01D 9/04* (2013.01); *F05D 2220/32* (2013.01); *F05D 2240/50* (2013.01)

(58) Field of Classification Search
CPC ..... F01D 5/141; F01D 9/041; F01D 25/162; F05D 2240/121; F05D 2240/128
See application file for complete search history.

(56) References Cited

U.S. PATENT DOCUMENTS 9,540,956 B2 * 1/2017 Salunkhe ..... F01D 25/28
9,631,518 B2 * 4/2017 Wong ..... F01D 25/30
(Continued)

FOREIGN PATENT DOCUMENTS

EP 1482130 A2 12/2004
EP 2559850 A1 2/2013
EP 3241989 A1 11/2017

OTHER PUBLICATIONS

International Search Report and Written Opinion of the International Searching Authority dated Oct. 29, 2020 corresponding to PCT Application No. PCT/US2020/023838 filed Mar. 20, 2020.

*Primary Examiner* — Christopher R Legendre

(57) ABSTRACT

A turbine operable to convey a flow of exhaust gas along a central axis includes a strut having a flow portion positioned within the flow of exhaust gas and a strut cover having a length and positioned to surround the flow portion of the strut, the strut cover including a leading-edge portion, a mid-chord portion, and a trailing-edge portion. The mid-chord portion has a uniform cross-section, and the trailing-edge portion has a trailing-edge center positioned such that the mid-chord portion and the trailing-edge portion define a master chord plane. The leading-edge portion defines a leading-edge nose, and the leading-edge portion is twisted with respect to the master chord plane and the leading-edge nose along the length defines a curve that is not coincident with the master chord plane.

19 Claims, 7 Drawing Sheets

(56) References Cited

U.S. PATENT DOCUMENTS

| | | | | |
|---|---|---|---|---|
| 9,644,497 | B2 | 5/2017 | Salunkhe et al. | |
| 10,502,084 | B2 | 12/2019 | Humhauser et al. | |
| 2023/0036034 | A1* | 2/2023 | Flitan | F01D 5/141 |

* cited by examiner

STRUT COVER FOR A TURBINE

BACKGROUND

Turbine engines, including gas turbines and steam turbines include an exhaust section in which a working fluid is exhausted from the turbine. In the case of gas turbines, the working fluid is a flow of combustion gas while a steam turbine exhausts a flow of steam and/or water vapor. Often, struts are placed in this exhaust flow to support components such as bearings that are positioned in the flow. These struts can interfere with the flow and create an increased back-pressure that reduces the efficiency of the turbine.

BRIEF SUMMARY

In one construction, a turbine operable to produce a flow of exhaust gas along a central axis includes a strut having a flow portion positioned within the flow of exhaust gas and a strut cover having a length and positioned to surround the flow portion of the strut, the strut cover including a leading-edge portion, a mid-chord portion, and a trailing-edge portion. The mid-chord portion has a uniform cross-section, and the trailing-edge portion has a trailing-edge center positioned such that the mid-chord portion and the trailing-edge portion define a master chord plane. The leading-edge portion defines a leading-edge nose, and the leading-edge portion is twisted with respect to the master chord plane and the leading-edge nose along the length defines a curve that is not coincident with the master chord plane.

In another construction, a turbine includes an exhaust portion having an inner flow liner and an outer flow liner that cooperate to define an annular flow space, the annular flow space arranged to receive a flow in a flow direction. A strut cover is positioned in the annular flow space and has a length normal to the flow direction between the inner flow liner and the outer flow liner. The strut cover includes a uniform mid-chord portion that defines a master chord plane, a trailing-edge portion having a trailing-edge center that resides on the master chord plane, and a leading-edge portion having a leading-edge nose that is twisted with respect to the master chord plane such that the leading-edge nose intersects the master chord plane at no more than one point along the length.

In still another construction, a turbine includes an exhaust portion having an inner flow liner and an outer flow liner that cooperate to define an annular flow space. A strut has a flow portion positioned in the annular flow space and extending along an axis between the inner flow liner and the outer flow liner. A strut cover is positioned in the annular flow space and extends between the inner flow liner and the outer flow liner, the strut cover surrounding the flow portion and including a leading-edge portion, a mid-chord portion, and a trailing-edge portion that cooperate to define a plurality of cross-sections normal to the axis. Each cross-section defines a camber line and the camber lines in the mid-chord portion and the trailing-edge portion overlay one another and the camber lines in the leading-edge portion do not overlay one another.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
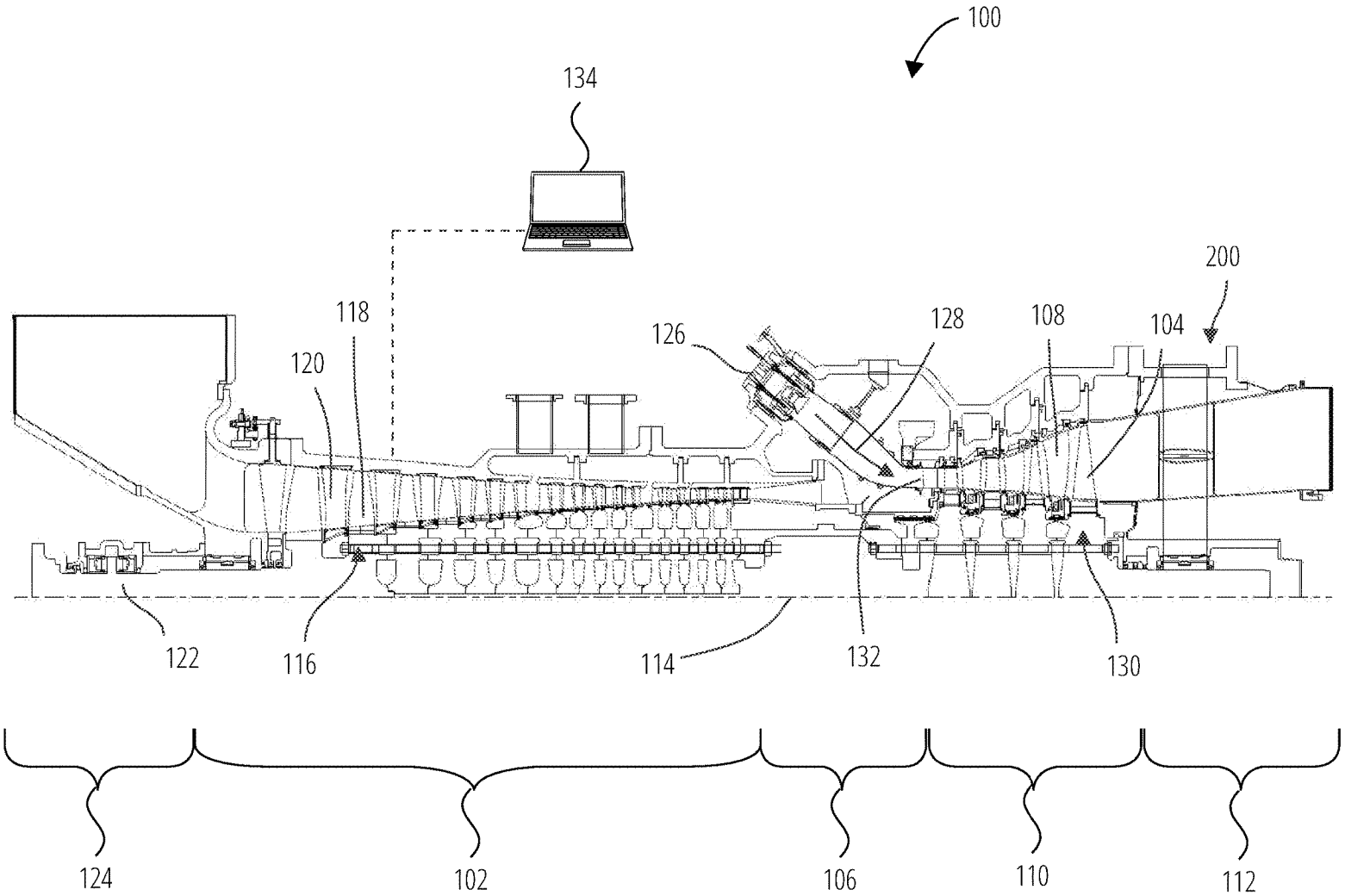
FIG. 1 is a longitudinal cross-sectional view of a gas turbine engine taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 106, and a turbine section 110 arranged along a central axis 114. The compressor section 102 includes a plurality of compressor stages 116 with each compressor stage 116 including a set of rotating blades 118 and a set of stationary vanes 120 or adjustable guide vanes. A rotor 122 supports the rotating blades 118 for rotation about the central axis 114 during operation. In some constructions, a single one-piece rotor 122 extends the length of the gas turbine engine 100 and is supported for rotation by a bearing at either end. In other constructions, the rotor 122 is assembled from several separate spools that are attached to one another or may include multiple disk sections that are attached via a bolt or plurality of bolts.

The compressor section 102 is in fluid communication with an inlet section 124 to allow the gas turbine engine 100 to draw atmospheric air into the compressor section 102. During operation of the gas turbine engine 100, the compressor section 102 draws in atmospheric air and compresses that air for delivery to the combustion section 106. The illustrated compressor section 102 is an example of one compressor section 102 with other arrangements and designs being possible.

In the illustrated construction, the combustion section 106 includes a plurality of separate combustors 126 that each operate to mix a flow of fuel with the compressed air from the compressor section 102 and to combust that air-fuel mixture to produce a flow of high temperature, high pressure combustion gases or exhaust gas 128. Of course, many other arrangements of the combustion section 106 are possible.

The turbine section 110 includes a plurality of turbine stages 130 with each turbine stage 130 including a number of rotating turbine blades 104 and a number of stationary turbine vanes 108. The turbine stages 130 are arranged to receive the exhaust gas 128 from the combustion section 106 at a turbine inlet 132 and expand that gas to convert thermal and pressure energy into rotating or mechanical work. The turbine section 110 is connected to the compressor section 102 to drive the compressor section 102. For gas turbine engines 100 used for power generation or as prime movers, the turbine section 110 is also connected to a generator, pump, or other device to be driven. As with the compressor section 102, other designs and arrangements of the turbine section 110 are possible.

An exhaust portion 112 is positioned downstream of the turbine section 110 and is arranged to receive the expanded flow of exhaust gas 128 from the final turbine stage 130 in the turbine section 110. The exhaust portion 112 is arranged to efficiently direct the exhaust gas 128 away from the turbine section 110 to assure efficient operation of the turbine section 110. The exhaust portion 112 also includes one or more strut assemblies 200 that will be discussed in greater detail with regard to FIG. 2. Many variations and design differences are possible in the exhaust portion 112. As such, the illustrated exhaust portion 112 is but one example of those variations.

A control system 134 is coupled to the gas turbine engine 100 and operates to monitor various operating parameters and to control various operations of the gas turbine engine 100. In preferred constructions the control system 134 is typically micro-processor based and includes memory devices and data storage devices for collecting, analyzing, and storing data. In addition, the control system 134 provides output data to various devices including monitors, printers, indicators, and the like that allow users to interface with the control system 134 to provide inputs or adjustments. In the example of a power generation system, a user may input a power output set point and the control system 134 may adjust the various control inputs to achieve that power output in an efficient manner.

The control system 134 can control various operating parameters including, but not limited to variable inlet guide vane positions, fuel flow rates and pressures, engine speed, valve positions, generator load, and generator excitation. Of course, other applications may have fewer or more controllable devices. The control system 134 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
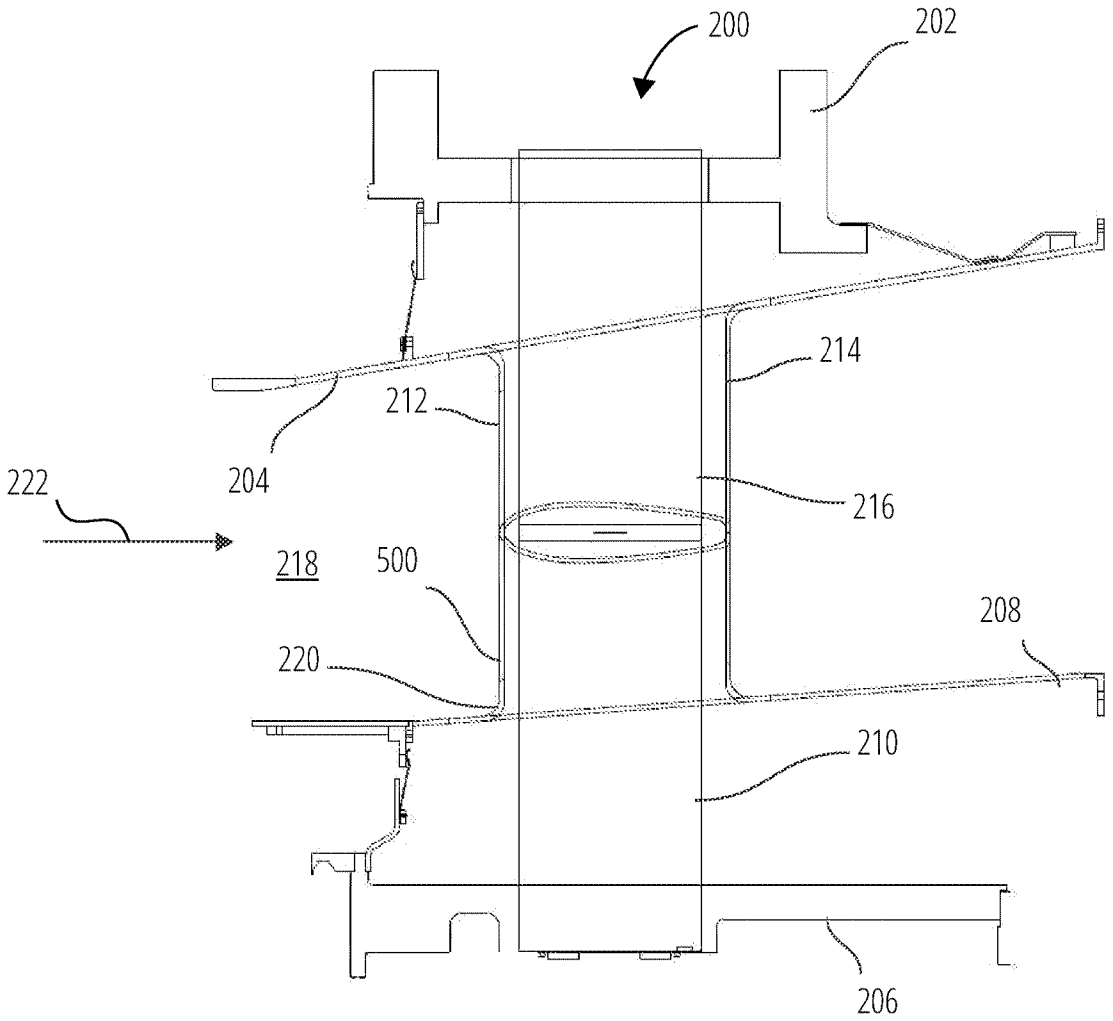
FIG. 2 illustrates a strut assembly in accordance with one embodiment.

FIG. 2 is an enlarged cross-sectional view of a strut assembly 200. It should be understood that most gas turbine engines 100 include several strut assemblies 200 that are similar to or identical to the one illustrated in FIG. 2. Typically, the strut assemblies 200 are positioned at a common axial location and distributed equally around the central axis 114 of the gas turbine engine 100 (e.g., four strut assemblies 200 would be ninety degrees apart). Of course, other arrangements and spacing are possible including unequal spacings, axially varying spacing, and even varying alignments of the different strut assemblies 200.

Each strut assembly 200 includes a strut 210 and a strut cover 500 arranged to cover the strut 210. In the illustrated construction, the strut 210 includes a first end that is fixedly attached to an outer casing 202 and a second end that is fixedly attached to a bearing casing 206 for a bearing (not shown). A flow portion 216 of the strut 210 extends between an inner flow liner 208 and an outer flow liner 204 where it is potentially exposed to the exhaust gas 128. Of course, each end could be attached to a different component as may be required by the design of the gas turbine engine 100. Attached as described, the strut 210 serves to rigidly attach the outer casing 202 and the bearing casing 206, thereby providing the necessary support for the bearing casing 206 and the rotor 122 which is supported by the bearing. The strut 210 passes through the outer flow liner 204 and the inner flow liner 208 and may or may not be attached to one or both of the outer flow liner 204 and the inner flow liner 208. The outer flow liner 204 and the inner flow liner 208 cooperate to define an annular flow space 218 through which the exhaust gas flows in a flow direction 222.

In many constructions, one or more of the struts 210 are hollow to provide a passage between the interior of the gas turbine engine 100 and the exterior. The passage is often used to direct instrument wires, air lines, lubricant lines and the like. For example, in the illustrated construction, one of the struts 210 would include lubricant lines that direct lubricant fluid to and from the bearing. In addition, vibration sensors within the bearing often require wires to pass the signals from the sensors to the exterior of the gas turbine engine 100 where they can be routed to the control system 134.

In some constructions, cross-strut assemblies are provided between some or all the adjacent pairs of strut assemblies 200. The cross-strut assemblies provide additional support and stability if needed. Each cross-strut assembly includes a cross-strut (often referred to as a gusset) and may include a cross-strut cover if the cross-strut is in the exhaust flow. The cross-strut provides the desired structural support and can be any shape, cross-section, or configuration desired. For example, box beams, I-beams, or solid beams could be employed as cross-struts.

The cross-strut cover surrounds or at least partially surrounds the cross-strut and is aerodynamically shaped to reduce any backpressure increase that might be caused by the cross-strut if it were in the flow of exhaust gas exiting the turbine. The cross-strut cover does not necessarily provide any structural support and can therefore be made from a thin sheet material. However, some constructions may use a more rigid or thicker material for the cross-strut cover such that it does provide some structural support. It should be noted that many gas turbine engine 100 constructions do not include or require cross-strut assemblies.

In preferred constructions, each strut 210 is welded to the outer casing 202 and the bearing casing 206. However, some constructions may use other attachment means such as fasteners. Similarly, each cross-strut is preferably welded to the struts 210 between which the cross-strut extends.

With continued reference to FIG. 2, the strut cover 500 extends from the outer flow liner 204 to the inner flow liner 208 and covers the strut 210. As illustrated in FIG. 2, each strut cover 500 cooperates with the outer flow liner 204 and the inner flow liner 208 to define two wall fillets 220. Of course, other constructions could omit one or both of the wall fillets 220.

Each strut cover 500 is aerodynamically shaped and covers one of the struts 210 so that the shape of the strut 210 can be selected for strength and stiffness without concern for aerodynamics. Thus, each strut 210 could be formed from a box beam, I-beam, solid beam, channel beam, or any other shape or combination of shapes desired.

The aerodynamic shape of the strut cover 500 includes a curved or elliptical leading-edge portion 504 and a narrower curved or elliptical trailing-edge portion 620. Tapered surfaces extend between the leading-edge portion 504 and the trailing-edge portion 620 to define a mid-chord portion 622 (illustrated in FIG. 6) to complete the shape.

In the illustrated construction, the leading-edge portion 504 extends along the length of the strut cover 500 and maintains a uniform axial position. Thus, the leading-edge portion 504 is substantially normal to the central axis 114. In the illustrated construction, the trailing-edge portion 620 is arranged normal to the central axis 114. Of course, in some constructions, one or both of the leading-edge portion 504 and the trailing-edge portion 620 may have a taper or lean such that the leading-edge portion 504 and/or the trailing-edge portion 620 defines an oblique angle with respect to the central axis 114. For example, the strut cover 500 illustrated in FIG. 6 and FIG. 7 includes a tapered or leaning trailing-edge portion 620.

Figure 3:
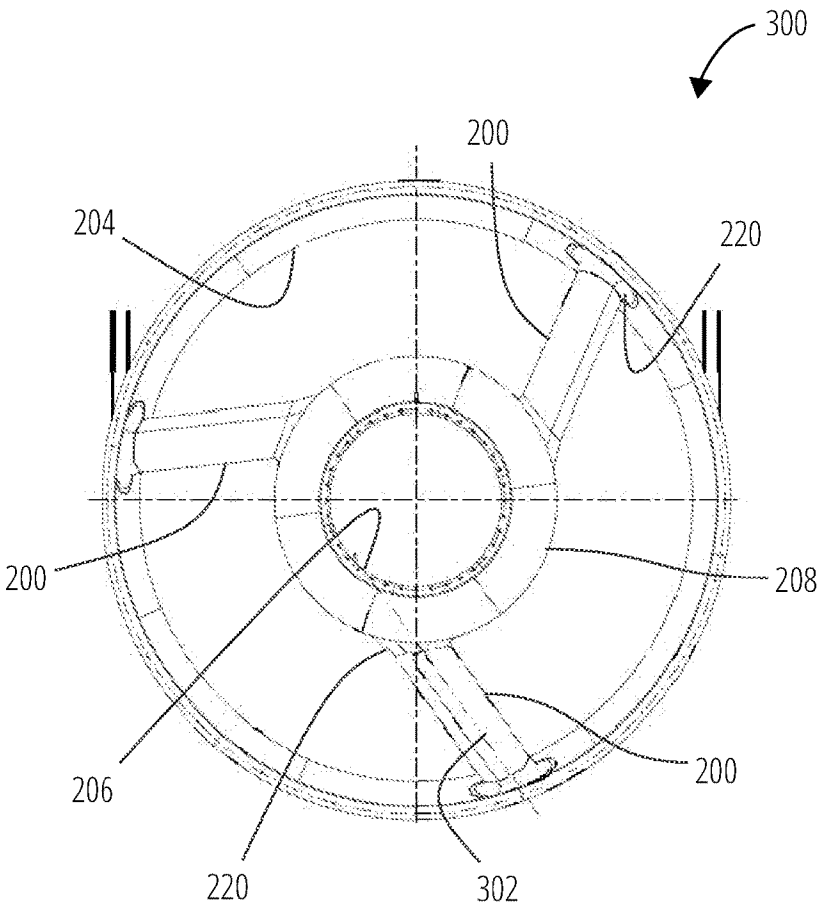
FIG. 3 illustrates a first arrangement of a plurality of strut assemblies for a gas turbine engine such as the one illustrated in FIG. 1.

FIG. 3 illustrates a first arrangement of a plurality of strut assemblies 300 which includes three separate strut assemblies 200 arranged about 120 degrees apart (circumferentially) from one another (i.e., within typical manufacturing tolerances). As illustrated in FIG. 3, each of the strut assemblies 200 extends along an axis that is oblique to a radial axis of the gas turbine engine 100. Specifically, each strut assembly 200 extends from the inner flow liner 208 to the outer flow liner 204 along a line or axis that is tangent to the bearing casing 206. More specifically, the master chord plane 302 of each strut assembly 200 is arranged to be tangent to the bearing casing 206.

While three equally spaced, non-radial strut assemblies 200 are illustrated in FIG. 3, other arrangements could vary the spacing between the strut assemblies 200, could include additional strut assemblies 200, or could include one or more radially arranged strut assemblies 200.

Figure 4:
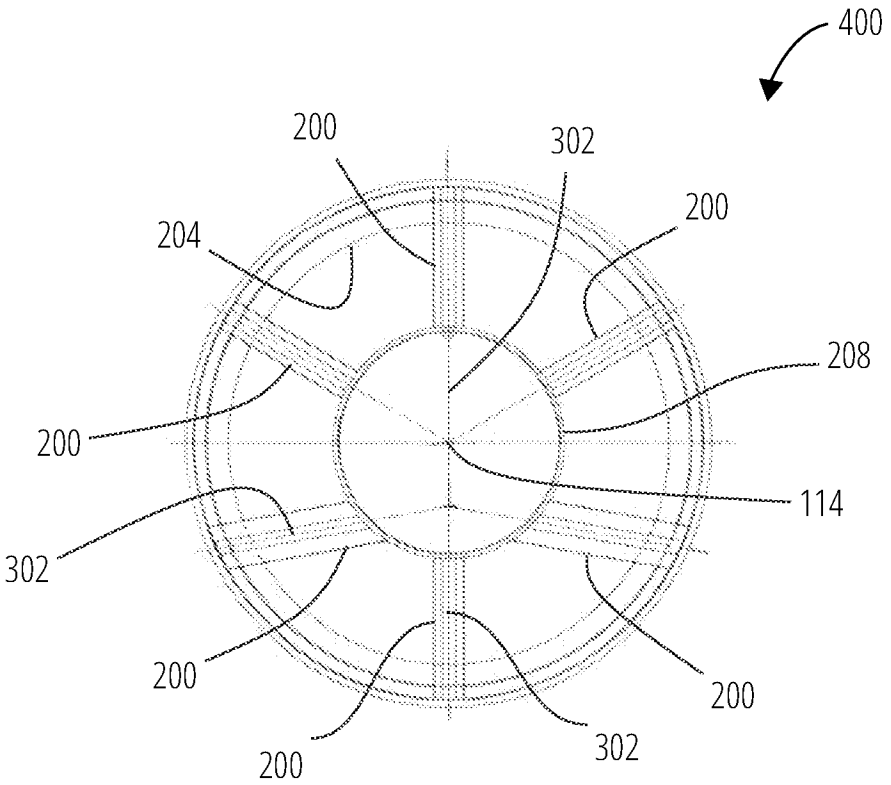
FIG. 4 illustrates a second arrangement of a plurality of strut assemblies for a gas turbine engine such as the one illustrated in FIG. 1.

FIG. 4 illustrates a second arrangement of a plurality of strut assemblies 400 that includes six strut assemblies 200 arranged around the circumference of the bearing casing 206. The arrangement includes a top-dead-center strut assembly 200 and a bottom-dead-center strut assembly 200 arranged along master chord planes 302 that are coincident with a radial plane that intersects the central axis 114. Two additional strut assemblies 200 are arranged along master chord planes 302 that are coincident with radial planes in the upper portion of the gas turbine engine 100. The final two strut assemblies 200 are arranged along non-radial master chord planes 302 in the lower portion of the gas turbine engine 100.

As with the arrangement of FIG. 3, other arrangements could include different or equal spacing between the strut assemblies 200, additional or fewer strut assemblies 200, and more or fewer radially aligned master chord planes 302.

Figure 5:
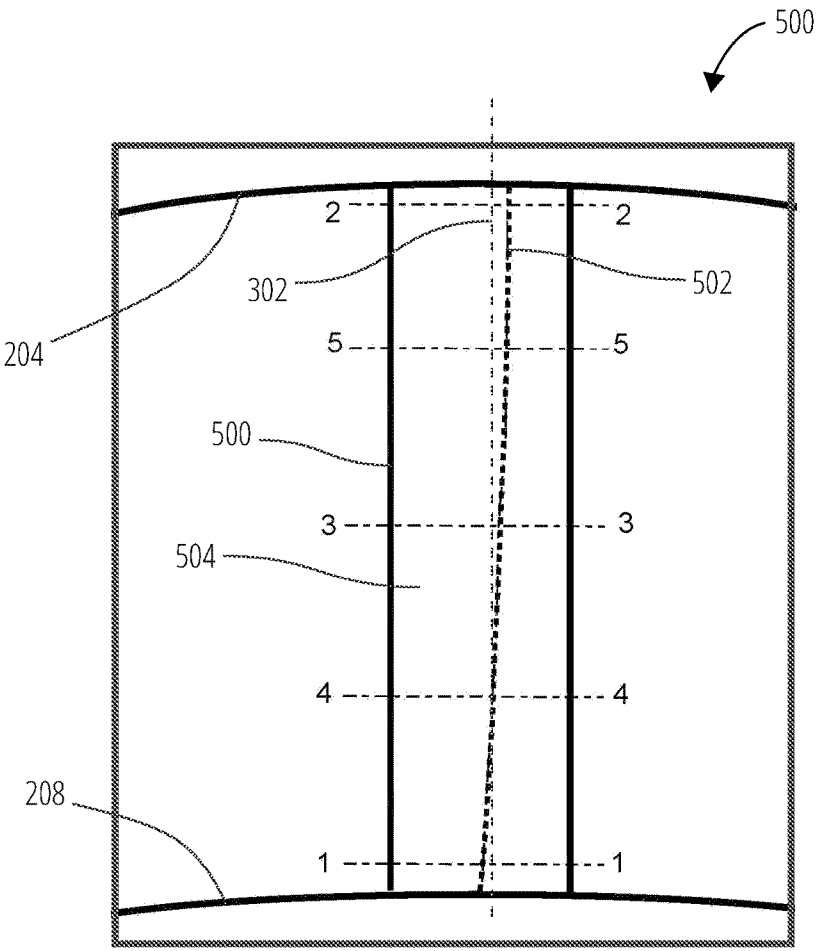
FIG. 5 is an axial view of a strut cover looking in the flow direction.
Figure 6:
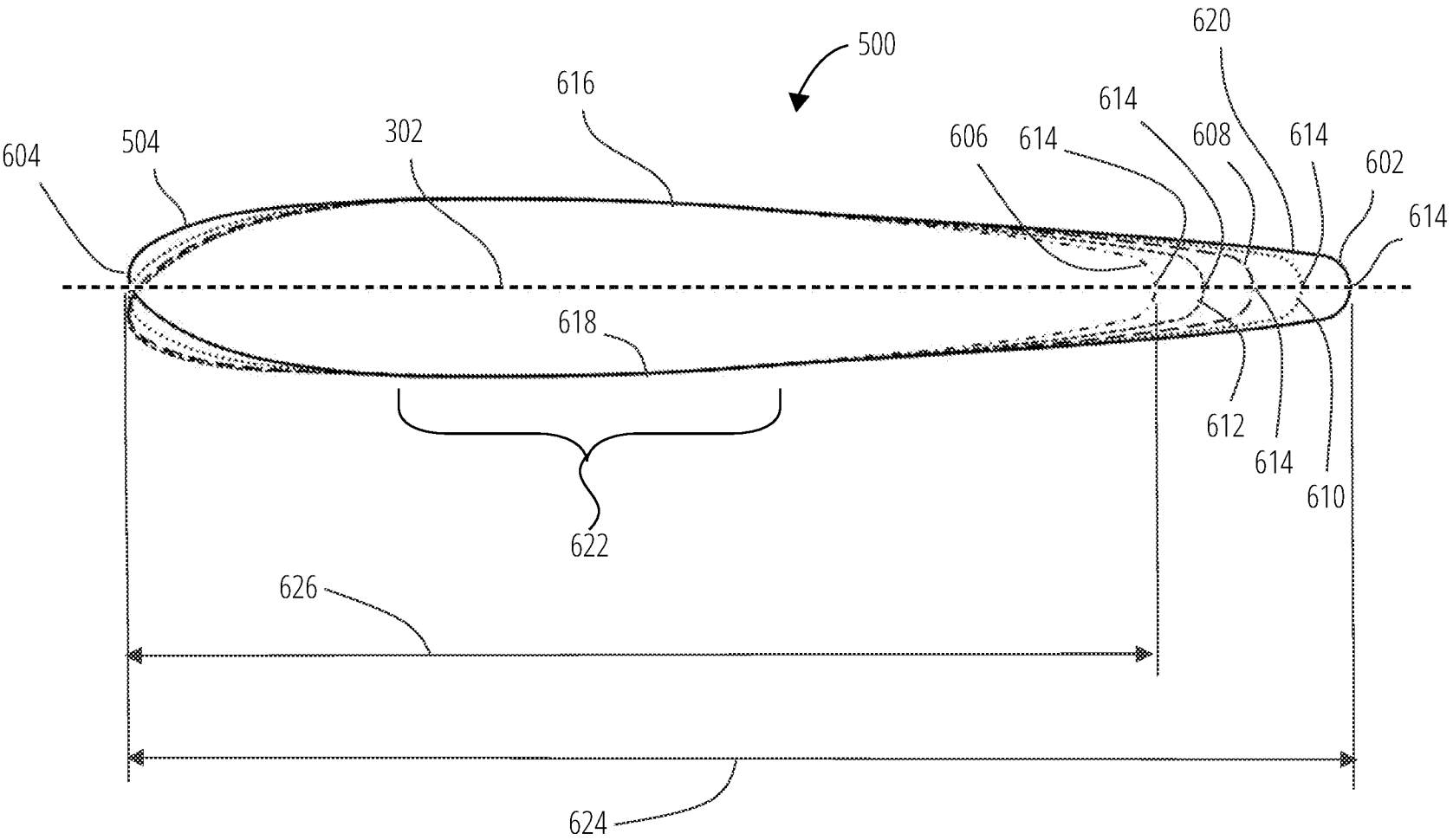
FIG. 6 illustrates a plurality of cross-sections of the strut cover of FIG. 5, taken along lines 1-1, 2-2, 3-3, 4-4, and 5-5 of FIG. 5.
Figure 7:
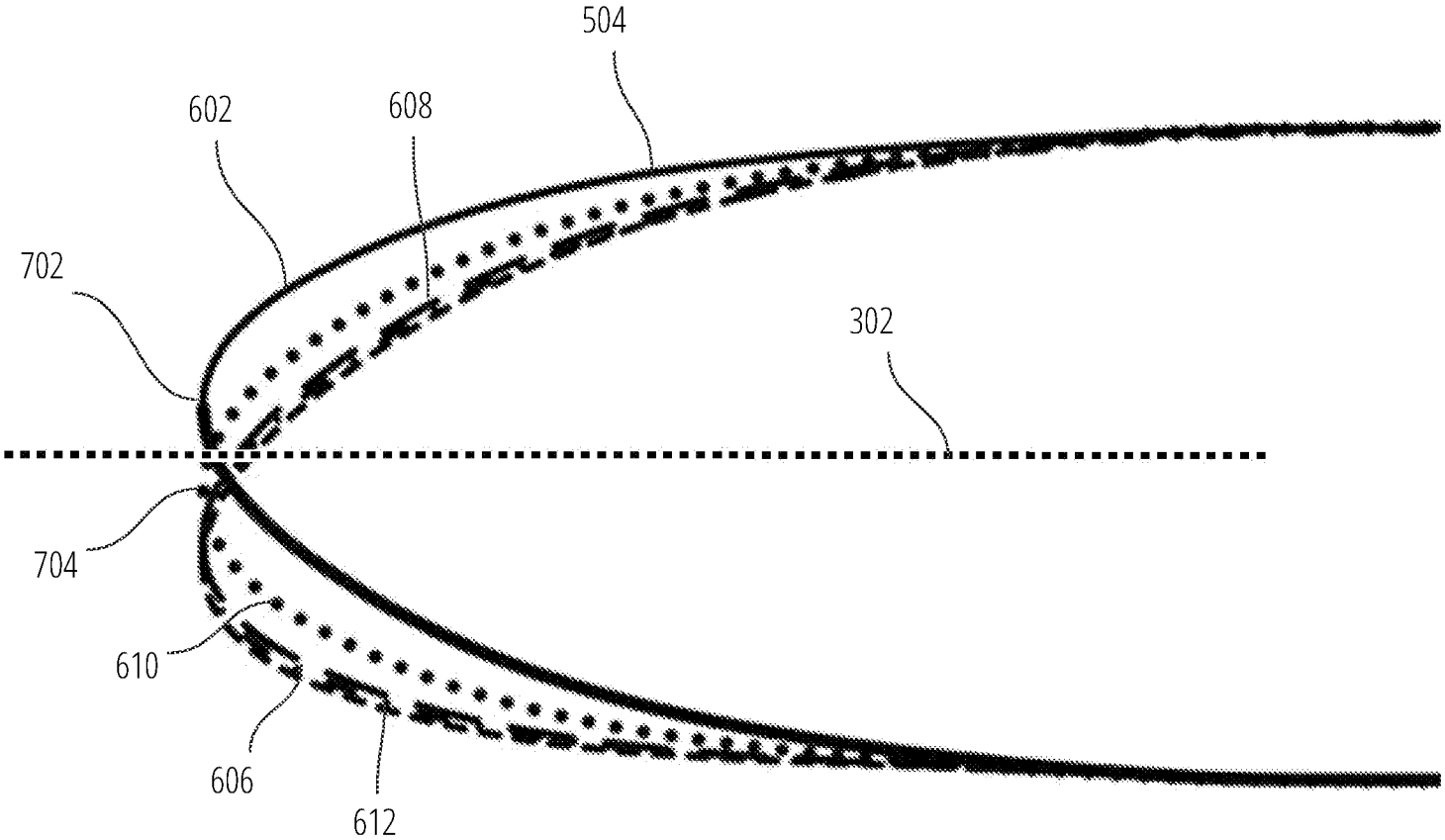
FIG. 7 is an enlarged view of a portion of the cross-sections of FIG. 6.

It is important to note that the arrangement, positioning, or number of strut assemblies 200 employed in the gas turbine engine 100 are not critical to the arrangement of the strut cover 500 as the arrangements described with regard to FIG. 5 through FIG. 7 are not affected by any of these factors.

FIG. 5 is an axial view of one of the strut covers 500 looking in the flow direction 222 of the exhaust gas 128. A master chord plane 302 (sometimes referred to as a skeleton plane or a center plane) is illustrated as a plane that passes through the full length of the strut cover 500 and substantially bisects the strut cover 500. A leading-edge nose 502 is defined as the locus of the furthest upstream points (i.e., the leading-edge center 604) of the leading-edge portion 504 of the various cross-sections taken parallel to the flow direction of the strut cover 500. As illustrated in FIG. 5, the leading-edge nose 502 defines a curve that does not reside on or coincide with the master chord plane 302 but rather is offset from and, in this construction crosses the master chord plane 302 at no more than one location.

It should be noted that some constructions could include a leading-edge nose 502 that defines a curve that never crosses the master chord plane 302 with preferred constructions including a single crossing. In some constructions, multiple crossings could occur with the leading-edge nose 502 resembling a parabola, a hyperbola, or a higher order curve.

FIG. 6 better illustrates the aerodynamic shape of one possible arrangement of the strut cover 500. Specifically, FIG. 6 illustrates five cross-sections each taken at a different distance from the inner flow liner 208 to better illustrate the variation in the shape of the strut cover 500 over the length of the strut cover 500.

FIG. 6 illustrates a master chord plane 302 that substantially bisects the various cross-sections (i.e., with the exception of the leading-edge portion 504 which is not necessarily bisected). The master chord plane 302 is parallel to the general direction of flow and provides a reference for the various cross-sections.

The master chord plane 302 defines a camber line for each cross-section having a leading-edge center 604 and a trailing-edge center 614 on the master chord plane 302. A camber line is defined as the locus of points halfway between a first curved edge 616 and a second curved edge 618 that define the complete strut cover 500. For a symmetrical strut cover 500 having a leading-edge center 604 that is not twisted, the camber line is located on the master chord plane 302. The camber lines of the other cross-sections are generally coincident with the master chord plane 302 from the trailing-edge center 614 to a point near the leading-edge portion 504 where the camber line will diverge slightly to match the twist of the leading-edge portion 504 for each cross-section.

A first cross-section 602 is taken along line 1-1 of FIG. 5 at a point near the intersection of the strut cover 500 and the inner flow liner 208. The first cross-section 602 defines a trailing-edge center 614 that intersects the master chord plane 302 and a leading-edge nose 502 that is offset from the master chord plane 302. The distance between the trailing-edge center 614 and the leading-edge center 604 of the first cross-section 602 defines a first length 624 of the strut cover 500.

A second cross-section 606 of the strut cover 500 is taken along line 2-2 of FIG. 5 at a point near the intersection of the strut cover 500 and the outer flow liner 204. The second cross-section 606 also defines a trailing-edge center 614 that falls on the master chord plane 302 and a leading-edge center 604 that is offset from the master chord plane 302. The distance between the trailing-edge center 614 and the leading-edge center 604 of the second cross-section 606 defines a second length of the strut cover 500. The second length 626 is shorter than the first length 624 as the strut cover 500 includes a tapered or leaning trailing-edge portion 620.

A third cross-section 608 of the strut cover 500 is taken along line 3-3 of FIG. 5 at about the midpoint of the strut cover 500. The third cross-section 608 also defines a trailing-edge center 614 that falls on the master chord plane 302 and a leading-edge center 604 that is offset from the master chord plane 302. The distance between the trailing-edge center 614 and the leading-edge center 604 of the third cross-section 608 defines a third length of the strut cover 500. The third length is between the first length 624 and the second length 626.

A fourth cross-section 610 of the strut cover 500 is taken along line 4-4 of FIG. 5 at a point between the first cross-section 602 and the third cross-section 608 of the strut cover 500. The fourth cross-section 610 also defines a trailing-edge center 614 that falls on the master chord plane 302 and a leading-edge center 604 that is offset from the master chord plane 302. The distance between the trailing-edge center 614 and the leading-edge center 604 of the fourth cross-section 610 defines a fourth length of the strut cover 500. The fourth length is between the first length 624 and the third length.

A fifth cross-section 612 of the strut cover 500 is taken along line 5-5 of FIG. 5 at a point between the second cross-section 606 and the third cross-section 608 of the strut cover 500. The fifth cross-section 612 also defines a trailing-edge center 614 that falls on the master chord plane 302 and a leading-edge center 604 that is offset from the master chord plane 302. The distance between the trailing-edge center 614 and the leading-edge center 604 of the fifth cross-section 612 defines a fifth length of the strut cover 500. The fifth length is between the second length 626 and the third length.

In the construction illustrated in FIG. 5, FIG. 6, and FIG. 7, the leading-edge nose 502 crosses the master chord plane 302 at some point between the first cross-section 602 and the fourth cross-section 610 near the fourth cross-section 610. Of course, other constructions could include a different arrangement that results in the leading-edge nose 502 crossing the master chord plane 302 at a different point. In addition, different twists, including larger twists, smaller twists, and twists in different directions are contemplated, including arrangements in which the leading-edge nose 502 does not cross the master chord plane 302.

The leading-edge portion 504 of each of the cross-sections is arranged such that regardless of the location of the leading-edge center 604, the leading-edge portion 504 blends into the first curved edge 616 and the second curved edge 618 that are aligned in the length direction of the strut cover 500 for all the cross-sections. Thus, when viewed in the length direction, as illustrated in FIG. 6, the first curved edges 616 of all the cross-sections overlay one another and appear coincident. Similarly, the second curved edges 618 of all the cross-sections overlay one another and appear coincident.

With continued reference to FIG. 6, each of the first curved edges 616 blends into its respective trailing-edge portion 620 such that as the first curved edges 616 approach their respective trailing-edge portion 620 they diverge from one another. Similarly, each of the second curved edges 618 blends into its respective trailing-edge portion 620 such that as the second curved edges 618 approach the trailing-edge portion 620 they diverge from one another.

In constructions in which the trailing-edge portion 620 does not have a lean or a slant, the trailing-edge portions 620 of each of the various cross-sections will overlay one another and appear to be coincident when viewed in the length direction such as that illustrated in FIG. 6.

FIG. 7 is an enlarged view of the leading-edge portion 504 of the strut cover 500 that better illustrates the offsets of the leading-edge portions 504 of the various cross-sections. As can be seen, the first cross-section 602 defines a first leading edge center 702 that is illustrated as being above the master chord plane 302. This would correspond with a twist to the left of the master chord plane 302 or counterclockwise when looking in the direction of flow (i.e., in FIG. 5). The fourth cross-section 610 defines a fourth leading edge center 704 that is illustrated as falling slightly below the master chord plane 302. Thus, the leading-edge nose 502 crosses the master chord plane 302 at some point between the first cross-section 602 and the fourth cross-section 610. The remaining cross-sections are offset further below the master chord plane 302 with the second cross-section 606 and the fifth cross-section 612 being very close to one another. The twist of these cross-sections corresponds to a twist to the right or clockwise when looking in the direction of flow (i.e., in FIG. 5). Of course, different twist shapes, directions, magnitudes, and crossing points are possible such that the invention should not be limited to the example provided herein. Thus, the strut cover 500 illustrated in FIG. 6 and FIG. 7 has an aerodynamic shape that includes a twist of the leading-edge portion 212 with respect to the master chord plane 302 but that also includes a mid-chord portion 622 and a trailing-edge portion 214 that are symmetric with respect to the master chord plane 302.

In use, a plurality of struts 210 are attached to the outer casing 202 and the bearing casing 206 or other internal component to support the bearing casing 206 (or any other internal component) in the desired position. The size, shape, and quantity of struts 210 are selected to provide the desired support and stiffness for the bearing casing 206 or other internal components. In the illustrated construction, the bearing casing 206 at least partially supports the rotor 122 and must provide the necessary strength for that support as well as a sufficient rigidity to minimize unwanted vibrations.

Strut covers 500 extend between the inner flow liner 208 and the outer flow liner 204 and cover the strut 210 to protect the interior components from direct contact with the exhaust gas 128 and to provide an aerodynamic shape that reduces losses that could arise in response to flow interruptions caused by the struts 210. The strut covers 500 include a leading-edge portion 504 that defines a leading-edge nose 502 that is preferably positioned such that a tangent to the leading-edge nose 502 is normal to the flow direction.

However, during operation, the flow exiting the turbine section 110 may have some swirl or spin. The strut covers 500 are similarly twisted to align the leading-edge nose 502 normal to the flow at all locations. At some point along the length of the strut covers 500 the flow exiting the turbine section 110 is flowing parallel to the central axis 114 and at this point the leading-edge nose 502 is aligned with the master chord plane 302 that divides each strut cover 500. Between this point and the inner flow liner 208, the leading-edge nose 502 may be twisted in a first direction and between this point and the outer flow liner 204, the leading-edge nose 502 may be twisted in the opposite direction.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A turbine operable to convey a flow of exhaust gas along a central axis, the turbine comprising:

a strut having a flow portion positioned within the flow of exhaust gas; and a strut cover having a length and positioned to surround the flow portion of the strut, the strut cover including a leading-edge portion, a mid-chord portion, and a trailing-edge portion, the mid-chord portion having a uniform cross-section, and the trailing-edge portion having a trailing-edge center positioned such that the mid-chord portion and the trailing-edge portion are symmetric about a master chord plane, wherein the leading-edge portion defines a leading-edge nose, and wherein the leading-edge portion is twisted with respect to the master chord plane and the leading-edge nose along the length defines a curve that is not coincident with the master chord plane.

2. The turbine of claim 1, further comprising an exhaust portion including an inner flow liner and an outer flow liner that cooperate to define an annular flow space, and wherein the flow portion is disposed within the annular flow space.

3. The turbine of claim 2, wherein the strut cover is coupled to the inner flow liner and the outer flow liner, and the length extends between the inner flow liner and the outer flow liner.

4. The turbine of claim 3, further comprising a first wall fillet formed between the inner flow liner and the strut cover and a second wall fillet formed between the outer flow liner and the strut cover.

5. The turbine of claim 1, wherein the leading-edge portion includes a leading edge that extends the full length, and wherein the leading edge nose crosses the master chord plane at a single point.

6. The turbine of claim 5, wherein a distance from the leading-edge center to the trailing-edge center measured parallel to the central axis is greater near the inner flow liner than near the outer flow liner.

7. The turbine of claim 1, wherein the strut is the first of a plurality of struts and the strut cover is a first of a plurality of strut covers, and wherein each strut of the plurality of struts and each strut cover of the plurality of strut covers are circumferentially spaced apart from one another.

8. The turbine of claim 7, wherein one of the strut covers of the plurality of strut covers is arranged at an oblique angle with respect to a radial axis of the turbine.

9. A turbine comprising:

an exhaust portion having an inner flow liner and an outer flow liner that cooperate to define an annular flow space, the annular flow space arranged to receive a flow in a flow direction; and a strut cover positioned in the annular flow space and having a length normal to the flow direction between the inner flow liner and the outer flow liner, the strut cover including a uniform mid-chord portion that defines a master chord plane, a trailing-edge portion having a trailing-edge center that resides on the master chord plane, and a leading-edge portion having a leading-edge nose that is twisted with respect to the master chord plane such that the leading-edge nose crosses the master chord plane at a single point between the inner flow liner and the outer flow liner.

10. The turbine of claim 9, wherein the strut cover is coupled to the inner flow liner and the outer flow liner, and wherein a first wall fillet is formed between the inner flow liner and the strut cover and a second wall fillet is formed between the outer flow liner and the strut cover.

11. The turbine of claim 9, wherein the master chord plane is a radial plane that includes a central axis of the turbine.

12. The turbine of claim 9, wherein a distance from the leading-edge nose to the trailing-edge center measured parallel to the flow direction is greater near the inner flow liner than near the outer flow liner.

13. The turbine of claim 9, wherein the strut cover is a first of a plurality of strut covers, and wherein each strut cover of the plurality of strut covers are circumferentially spaced apart from one another.

14. The turbine of claim 13, wherein one of the strut covers of the plurality of strut covers is arranged at an oblique angle with respect to a radial axis of the turbine.

15. A turbine comprising:

an exhaust portion having an inner flow liner and an outer flow liner that cooperate to define an annular flow space;

a strut having a flow portion positioned in the annular flow space and extending along an axis between the inner flow liner and the outer flow liner; and a strut cover positioned in the annular flow space and extending between the inner flow liner and the outer flow liner, the strut cover surrounding the flow portion and including a leading-edge portion, a mid-chord portion, and a trailing-edge portion that cooperate to define a plurality of cross-sections normal to the axis, and wherein each cross-section defines a camber line and wherein the camber lines overlay one another in the mid-chord portion and the trailing-edge portion and the camber lines do not overlay one another in the leading-edge portion.

16. The turbine of claim 15, wherein the strut cover is coupled to the inner flow liner and the outer flow liner, and wherein a first wall fillet is formed between the inner flow liner and the strut cover and a second wall fillet is formed between the outer flow liner and the strut cover.

17. The turbine of claim 15, wherein each of the plurality of cross-sections includes a leading-edge center and a trailing-edge center and defines a length measured from the leading-edge center to the trailing-edge center, and wherein the length is not uniform in the plurality of cross-sections.

18. The turbine of claim 17, wherein the trailing-edge portion of each of the plurality of cross-sections cooperate to define a tapered trailing-edge portion.

19. The turbine of claim 15, wherein the strut cover is a first of a plurality of strut covers, and wherein each strut cover of the plurality of strut covers are circumferentially spaced apart from one another, and wherein the spacing is unequal.

* * * * *